US011381002B2

(12) United States Patent
Piau et al.

(10) Patent No.: US 11,381,002 B2
(45) Date of Patent: Jul. 5, 2022

(54) COATING FOR THE CONCEALMENT OF OBJECTS FROM THE ELECTROMAGNETIC RADIATION OF ANTENNAS

(71) Applicant: Airbus, Blagnac (FR)

(72) Inventors: Gérard-Pascal Piau, Courgent (FR); André De Lustrac, Sceaux (FR); Tatiana Borissov, Limours (FR)

(73) Assignee: AIRBUS SAS, Blagnac (FR)

( * ) Notice: Subject to any disclaimer, the term of this patent is extended or adjusted under 35 U.S.C. 154(b) by 690 days.

(21) Appl. No.: 16/342,616

(22) PCT Filed: Oct. 24, 2017

(86) PCT No.: PCT/FR2017/052938
§ 371 (c)(1),
(2) Date: Jul. 2, 2019

(87) PCT Pub. No.: WO2018/078282
PCT Pub. Date: May 3, 2018

(65) Prior Publication Data

US 2019/0334248 A1 Oct. 31, 2019

(30) Foreign Application Priority Data

Oct. 24, 2016 (FR) ..... 1660282

(51) Int. Cl.
*H01Q 17/00* (2006.01)
*H01Q 1/32* (2006.01)
*H01Q 1/38* (2006.01)

(52) U.S. Cl.
CPC ..... *H01Q 17/00* (2013.01); *H01Q 1/3233* (2013.01); *H01Q 1/38* (2013.01)

(58) Field of Classification Search
CPC ..... H01Q 17/00
See application file for complete search history.

(56) References Cited

U.S. PATENT DOCUMENTS 3,428,923 A 2/1969 Webb
8,253,639 B2 * 8/2012 Cohen ..... H01Q 21/205 343/753

(Continued)

OTHER PUBLICATIONS

International Search Report; priority document.

(Continued)

*Primary Examiner* — Peter M Bythrow
(74) *Attorney, Agent, or Firm* — Greer, Burns & Crain, Ltd.

(57) ABSTRACT

An assembly comprising a device and an obstacle subjected to an incident electromagnetic wave of wavelength λ. The obstacle is formed from an electrically conductive material and has a substantially cylindrical shape of transverse dimensions r with respect to a longitudinal axis (O, ez). The longitudinal axis is substantially perpendicular to a propagation direction of the incident electromagnetic wave. The obstacle further has a maximum transverse dimension d such that the ration λ/d is less than 1. The device is placed on all or a part of a surface of the obstacle and comprises a sleeve with a dielectric coating of equivalent relative permittivity EREQ, of height hP along a longitudinal axis of the sleeve, substantially equal to formula A, and a sleeve with an electrically conductive coating placed on the periphery of the dielectric coating.

11 Claims, 8 Drawing Sheets

(56) References Cited

U.S. PATENT DOCUMENTS 8,488,247 B2 * 7/2013 Cai ..... H01Q 17/00 359/741
9,095,043 B2 * 7/2015 Boulais ..... H01Q 15/04
9,691,509 B1 * 6/2017 Tzuang ..... H01Q 17/00
9,912,076 B2 * 3/2018 Bisiules ..... H01Q 1/38
2008/0024792 A1 * 1/2008 Pendry ..... F41H 3/00 356/602
2008/0165442 A1 * 7/2008 Cai ..... G02B 1/007 359/896
2009/0173886 A1 * 7/2009 Chowdhury ..... G01S 13/04 250/393
2009/0218523 A1 * 9/2009 Kare ..... G02B 1/002 250/505.1
2010/0020415 A1 * 1/2010 Tonucci ..... H01Q 15/0086 359/615
2010/0086272 A1 * 4/2010 Li ..... B82Y 20/00 359/896
2010/0110559 A1 * 5/2010 Cai ..... H01Q 17/00 703/1
2011/0085229 A1 * 4/2011 Lavrentovich ..... G02F 1/29 977/932
2013/0017348 A1 * 1/2013 Sanada ..... H01Q 17/00 428/34.1
2013/0330525 A1 * 12/2013 Yoshinaga ..... B32B 3/10 428/201
2014/0238734 A1 * 8/2014 Boulais ..... H01Q 15/04 174/350
2015/0303564 A1 * 10/2015 Payne ..... H01Q 1/523 343/841
2016/0111782 A1 * 4/2016 Alu ..... H01Q 1/521 343/810
2017/0018855 A1 * 1/2017 Sabbadini ..... H01Q 15/0066
2017/0133754 A1 * 5/2017 Raeker ..... H04B 5/0012
2017/0373385 A1 * 12/2017 Alu ..... H01Q 15/0086

OTHER PUBLICATIONS

French Search Report; priority document.
B. Sherlin, et al., "RCS Reduction with RF Cloak" Department of Electronics and Communication Engineering Coimbatore Institute of Technology, pp. 50-51, 2016.
L. Matekovits, et al., "Anisotropic Cloaking of a Metallic Cylinder" The 2014 International Workshop on Antenna Technology, pp. 216-219, 2014.

* cited by examiner

COATING FOR THE CONCEALMENT OF OBJECTS FROM THE ELECTROMAGNETIC RADIATION OF ANTENNAS

CROSS-REFERENCES TO RELATED APPLICATIONS

This application claims the benefit of the International Application No. PCT/FR2017/052938, filed on Oct. 24, 2017, and of the French patent application No. 1660282 filed on Oct. 24, 2016, the entire disclosures of which are incorporated herein by way of reference.

FIELD OF THE INVENTION

The present invention pertains to the field of electromagnetism.

More particularly, the invention pertains to the field of antennas.

More particularly, the invention relates to a device for attenuating the effects of an obstacle on the radiation characteristics of a radio antenna.

BACKGROUND OF THE INVENTION

Generally, the presence of a conductive obstacle in an electromagnetic field gives rise to variations in the electromagnetic field, for example a phase shift, which variations reveal the presence of the obstacle.

When such an object is located in proximity to a radio antenna, see FIG. 1, it generally results in the radiation pattern 302 of the antenna being deformed, see FIG. 2*b*, which has a negative effect on the performance thereof in certain directions with respect to the nominal pattern 301 of the antenna in the absence of an obstacle as illustrated in FIG. 2*a*. The expression "located in proximity" should be understood here to correspond to the cases in which the distance between the obstacle and the antenna is shorter than the wavelength of the radiation under consideration.

There are devices for making an object invisible to electromagnetic waves. They essentially consist in compensating for the variations in the electromagnetic field so as to erase the trace of the presence of the obstacle, and thus give the illusion of the obstacle not being there.

The device presented in the American patent application US 2014/0238734, for example, describes an electromagnetic veil surrounding the object to be concealed. The veil acts as a waveguide allowing the electromagnetic waves to bypass the obstacle at a faster phase velocity than in the absence of the obstacle, so as to compensate for the additional distance due to bypassing it, which distance results in a phase shift of the wave with respect to its free field value.

The device presented in the international patent application WO 2014/182398 describes a second technique using a metasurface allowing the wave diffracted by the obstacle to be reduced or cancelled out.

Another technique described in the American patent application US 2011/0163903 consists in generating an electromagnetic field that interferes with the electromagnetic wave diffracted by the obstacle, with a view to reducing it or cancelling it out. To achieve this, a mesh consisting of an electrically conductive material is placed around the conductive object to be concealed. The incident electromagnetic wave generates an electromagnetic field in the region located between the mesh and the object, allowing the wave diffracted by the object to be strongly attenuated, or even cancelled out entirely.

Two coating configurations for decreasing the radar cross section (RCS) of cylindrical metal objects are described in the publication "RCS reduction with RF cloak", Benitta Sherlin et al. A first coating configuration consists of an array of metal cones that are arranged around the periphery of a cylindrical metal object of circular cross section, and arranged periodically along a longitudinal axis of the object. Two metal cones are separated from one another by a dielectric.

A second coating configuration consists of an array of metal patterns that consist of patches of a microribbon strip, arranged periodically along a longitudinal axis of a cylindrical metal object of circular cross section, around the periphery of the cylindrical metal object. Two patterns are separated from one another by a dielectric.

A metasurface for decreasing the radar cross section (RCS) of a cylindrical metal object of circular cross section, consisting of a quasi-periodic arrangement printed on a dielectric, and enveloping the metal object, is described in the publication "Anisotropic cloaking of a metallic cylinder", Ladislau Matekovits et al.

The solutions presented above have the following drawbacks: their geometry and/or their complexity makes them difficult to implement and they may be expensive.

SUMMARY OF THE INVENTION

The device according to the invention provides an effective and economical solution to the problem of concealing an object from an antenna.

According to the invention, a coating arranged on the obstacle allows the radar cross section of the object to be drastically decreased, or even cancelled out entirely, by generating an electromagnetic wave that interferes with the wave diffracted by the object.

The invention relates to an assembly comprising an obstacle and a device, intended to be subjected to an incident electromagnetic wave of wavelength $\lambda$.

The obstacle is formed of an electrically conductive material and takes a substantially cylindrical shape of longitudinal axis (O; $e_z$), which longitudinal axis is substantially perpendicular to a direction of propagation of the incident electromagnetic wave. The obstacle furthermore has a maximum transverse dimension d such that the ratio $d/\lambda$ is lower than 1.

The device is placed over all or part of a surface of the obstacle so as to decrease a radar cross section of the obstacle, and includes:

a sleeve of a dielectric coating, of equivalent relative dielectric permittivity $\varepsilon_{req}$, of height hp, along a longitudinal axis of the sleeve, which is substantially equal to $$\frac{\lambda}{2\sqrt{\varepsilon_{req}}};$$

a sleeve of an electrically conductive coating placed around the periphery of the dielectric coating, of the same height hp along a longitudinal axis of the sleeve as the height of the dielectric coating sleeve.

In one embodiment, the dielectric coating is formed of a single dielectric material.

In one embodiment, the dielectric coating includes a plurality of dielectric materials, a relative dielectric permittivity and a thickness of each of the component dielectric materials of the coating determining the equivalent relative dielectric permittivity εreq.

In one embodiment, the height hp of the dielectric coating is optimized by means of direct electromagnetic simulation so as to adjust the height for the purpose of seeking a minimum radar cross section for the obstacle.

In one embodiment, a thickness of the dielectric coating is optimized by means of direct electromagnetic simulation so as to adjust the thickness for the purpose of seeking a minimum radar cross section for the obstacle.

In one embodiment, the obstacle is an elliptical cylinder, and the dielectric coating and the electrically conductive coating substantially take the shape of elliptical cylindrical sleeves. The dielectric coating is adjusted to fit the obstacle and the conductive coating is adjusted to fit the sleeve of the dielectric coating.

In another embodiment, the generatrix ellipse of the obstacle is a circle and the dielectric coating and the electrically conductive coating substantially take the shape of circular cylindrical sleeves.

In one embodiment, the obstacle, the dielectric coating and the conductive coating are slightly incurved.

In one embodiment, the obstacle and/or the electrically conductive coating comprise metals.

The invention also relates to a vehicle, in particular to a sea vehicle, an air vehicle or a land vehicle, including an assembly according to the invention.

BRIEF DESCRIPTION OF THE DRAWINGS

The invention will be better understood upon reading the following description and examining the accompanying figures. These are presented only by way of entirely non-limiting indication of the invention.

In the drawings, similar elements performing the same functions, even if they are shaped differently, bear the same reference number.

DETAILED DESCRIPTION OF THE PREFERRED EMBODIMENTS

Figure 1:
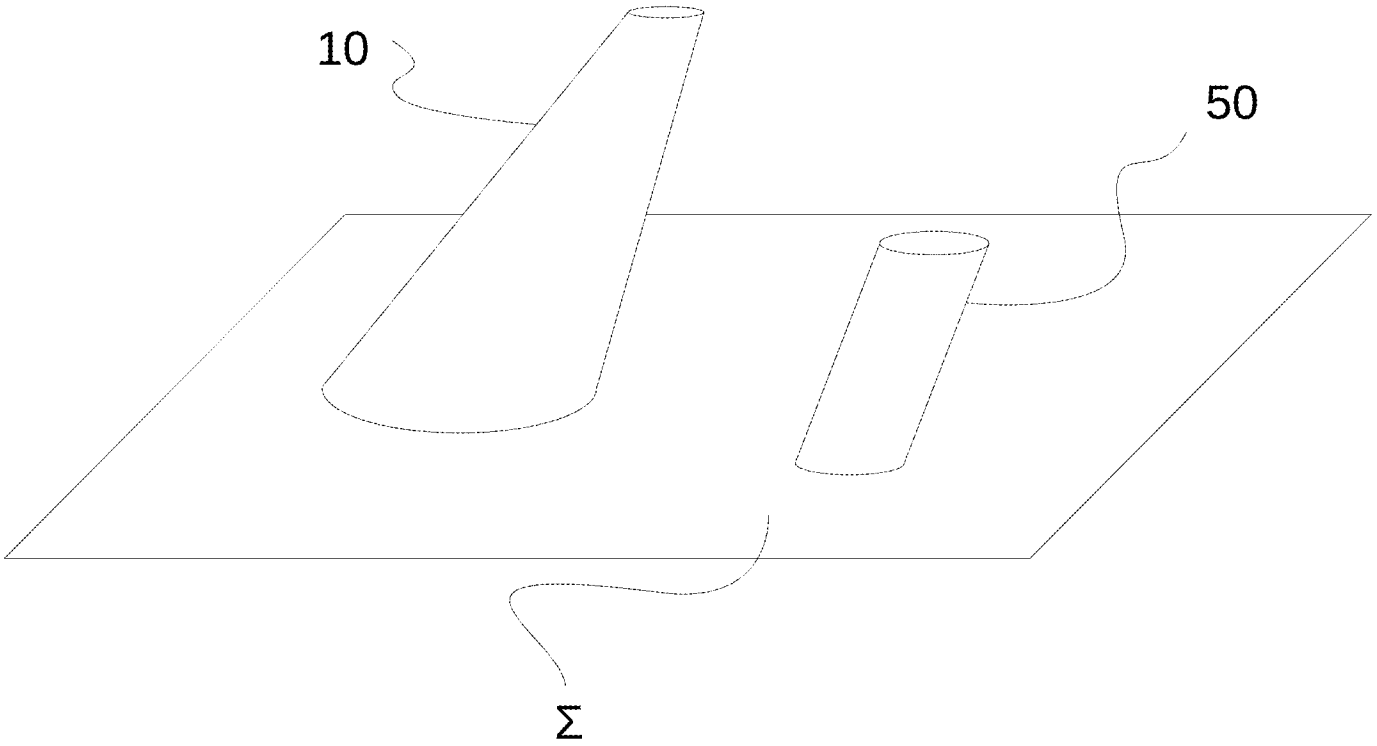
FIG. 1 Prior Art
FIG. 1 shows an antenna placed on a surface, in proximity to an obstacle.

Throughout the description, with the exception of the equations, in the same way as in the drawings, vectors are shown in bold so as to facilitate notation.

The components of a vector are identified by means of their coordinates in subscript, for example a vector E is defined in terms of Cartesian coordinates by its components (Ex, Ey, Ez) and in terms of cylindrical coordinates by its components (Eρ, Eθ, Ez).

When an orthonormal coordinate system (O; ex; ey; ez) is defined, the vertical direction will be designated as that given by the axis ez. This results from an arbitrary choice based on a commonly held convention, and does not limit the invention. As such, any plane parallel to the plane (O; ex; ey) is considered to be a horizontal plane.

The acronym EMW will be used throughout the description to refer to an electromagnetic wave. When this EMW has a wavelength λ, any physical quantity a having the dimension of a length could be rendered dimensionless with respect to this wavelength λ or to the wave number $k=2\pi/\lambda$. The dimensionless quantity will be referred to using the same notation as the dimensional quantity, along with an asterisk in superscript and the dimensionless quantity in subscript. For example, $a_\lambda^*=a/\lambda$ or $a_k^*=ka$. The acronym RCS will be used throughout the description to refer to a radar cross section of an object.

For numerical applications, the speed of light through air is considered to be equal to c=3×108 m/s.

The detailed description of the invention is provided using the example of application to an aircraft. The aircraft may, for example, be a carrier aircraft, a portion of which must be made invisible to the radiation of an antenna installed on this carrier aircraft. This example does not limit the invention, which is applicable to all situations, including for fixed objects, in which the radiation pattern of a radio antenna is disrupted by an obstacle.

FIG. 1 shows a surface Σ, for example an area of the fuselage of an aircraft, including an antenna 50, typically a VHF omnidirectional antenna designed for frequencies of between 108 MHz and 136 MHz, and in proximity to which an excrescence from the fuselage forms an obstacle 10 that is liable to interfere with the radio waves emitted or received by the antenna.

The obstacle 10 is, for example, a support for an item of equipment (not shown in the figure), for example an HF wire receiving antenna.

The interference with the radiation pattern of the antenna due to the obstacle 10 depends, in a known manner:

on the dimensions of the obstacle 10;

on a distance from the obstacle to the antenna;

on the radiofrequency properties of the constituent materials of the obstacle;

on the wavelengths under consideration.

The equations characterizing the propagation of radio waves are known to those skilled in the art, in particular for the study of antennas and their operation.

These equations will be repeated here only for the disclosure of the operating principles of the invention.

Figure 2A:
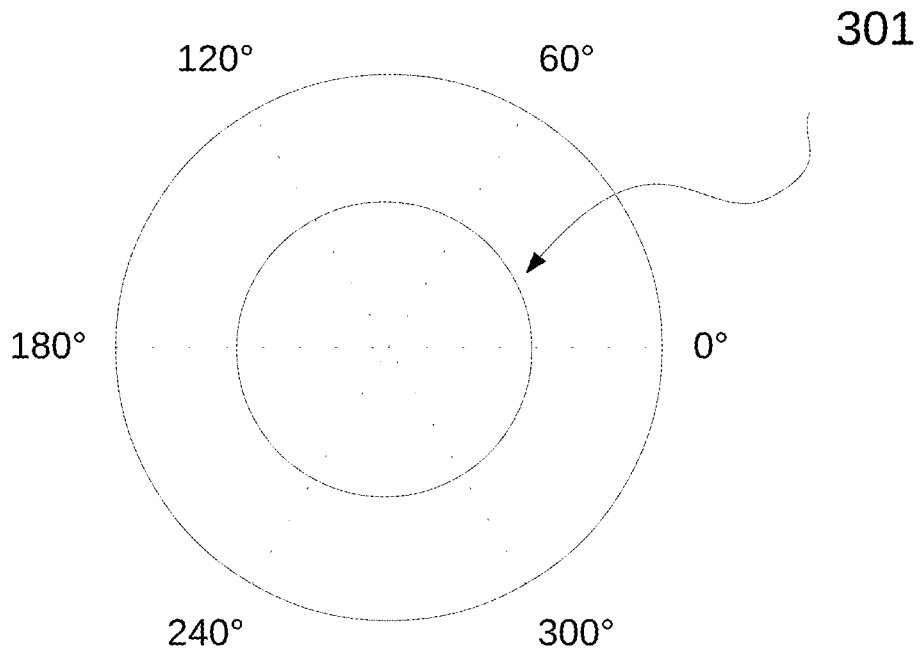
FIG. 2a Prior Art
FIG. 2*a*, cited above, shows the radiation pattern, in a horizontal plane, of a vertically polarized monopole omni-directional antenna.

FIG. 2*a* schematically shows a radiation pattern, the line 301 illustrating the radiation of an omnidirectional antenna in a horizontal plane, when the antenna is in free-field operation, i.e., no obstacle is interfering with the field radiated by the antenna.

Figure 2B:
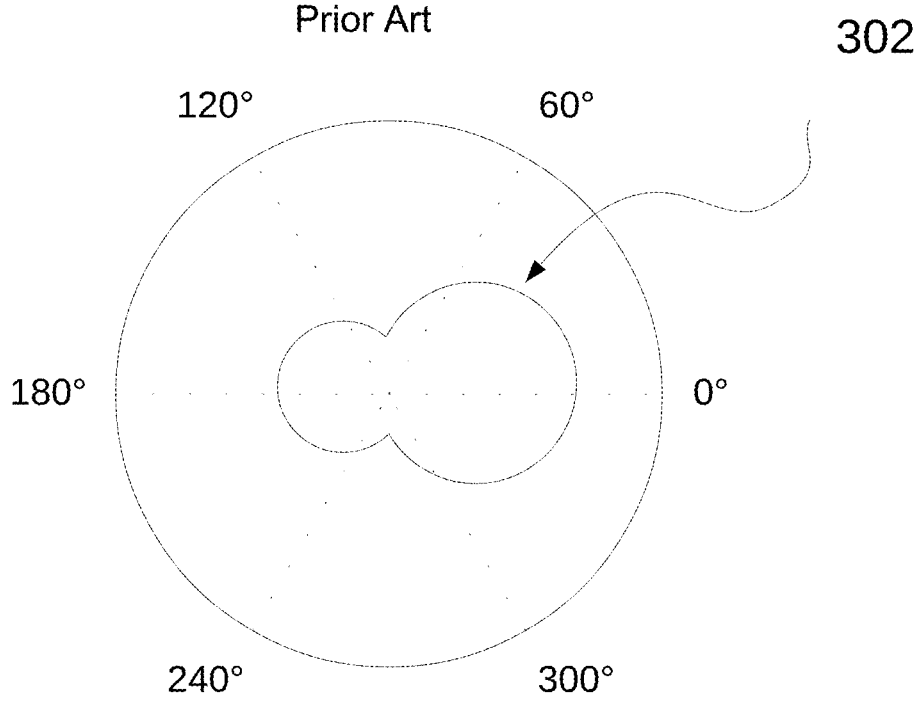
FIG. 2b Prior Art
FIG. 2*b*, cited above, shows the radiation pattern, in a horizontal plane, of the antenna of FIG. 2*a* in the presence of an obstacle.

FIG. 2*b* shows a radiation pattern, the line 302 illustrating the radiation of the antenna of FIG. 2*a* in the presence of an obstacle 10.

The extent of the deformation of the pattern due to the presence of the obstacle 10 naturally varies according to the conditions. For example, the closer an obstacle is to the antenna, and the larger it is, the greater the interference will be.

Figure 3:
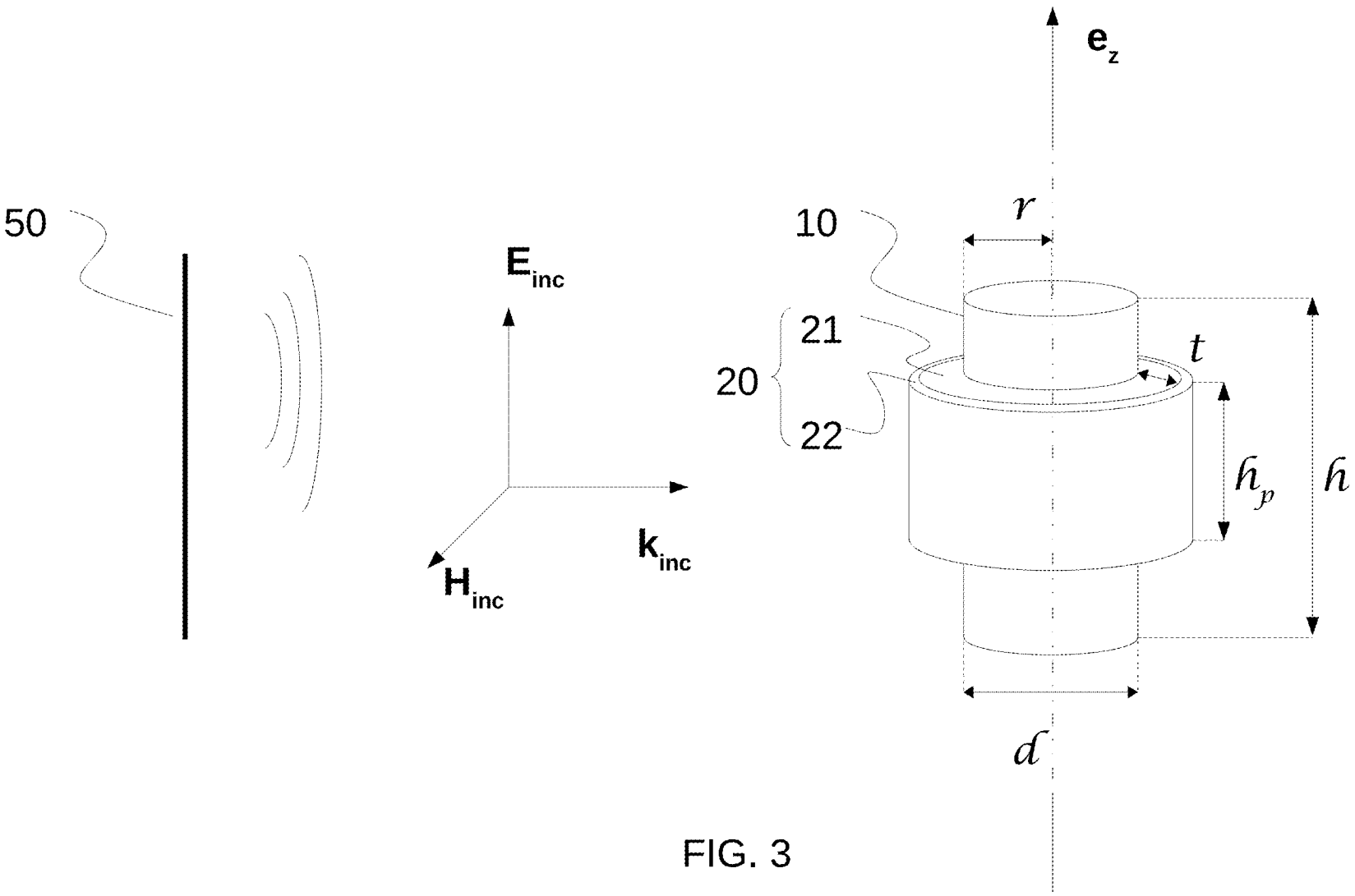
FIG. 3 is a perspective view of a first embodiment of the invention in which the obstacle is substantially cylindrical with a circular cross section, and the dielectric coating and the metal coating are substantially cylindrical with circular annular cross sections.

FIG. 3 schematically shows an electrically conductive obstacle 10 including a device 20 and exposed to an incident electromagnetic field (Einc; Hinc) of wavelength λ emitted by an antenna 50, according to one embodiment of the invention. Einc represents an incident electric field vector and Hinc represents an incident magnetic field vector.

In the embodiment of FIG. 3, the obstacle 10 is substantially cylindrical in shape, of circular cross section and of vertical longitudinal axis, of height h and of radius r.

A diameter of the obstacle 10 determines a maximum transverse dimension d of the obstacle. In the embodiment of FIG. 3, the ratio of the diameter of the cylindrical obstacle 10 to the wavelength λ is lower than or equal to 1.

The device 20 is implemented over at least a portion of the surface of the obstacle 10 and includes:

a solid dielectric coating 21 affixed or bonded to the obstacle 10;

a metal coating 22 affixed or bonded to the dielectric coating 21.

In the exemplary embodiment of FIG. 3, the dielectric coating 21 is affixed to the surface of the obstacle 10 so as to conform to the shape of the obstacle. The dielectric coating 21 has a thickness t, a relative permittivity εr intrinsic to the substrate, and a height hp dependent on the wavelength λ of the incident EMW.

In this nonlimiting exemplary embodiment, the dielectric coating 21 takes the shape of a substantially cylindrical sleeve of circular annular cross section, of inner radius r and of outer radius r+t.

The metal coating 22 is affixed to the surface of the dielectric coating 21 so as to conform to the shape of the dielectric coating.

In the exemplary embodiment of FIG. 3, the metal coating 22 is of the same height hp as the dielectric coating 21 and takes a similar shape. The metal coating has an inner radius r+t.

The metal coating should be thick enough to conduct the currents induced by the radiation of the antenna.

Furthermore, surfaces of unit normal vector ±ez of the dielectric coating 21 are not covered by the metal coating 22 so as to allow, during the implementation of the device 20, the radiation of an EMW present in the dielectric coating.

The obstacle 10 and the device 20 thus define an electromagnetic cavity filled with the dielectric material of the dielectric coating 21.

The principles and operation of the device 20 will be better understood in the light of the theoretical foundations underpinning the invention and which are presented below using a simple case and simplifying assumptions allowed by the case.

Figure 4:
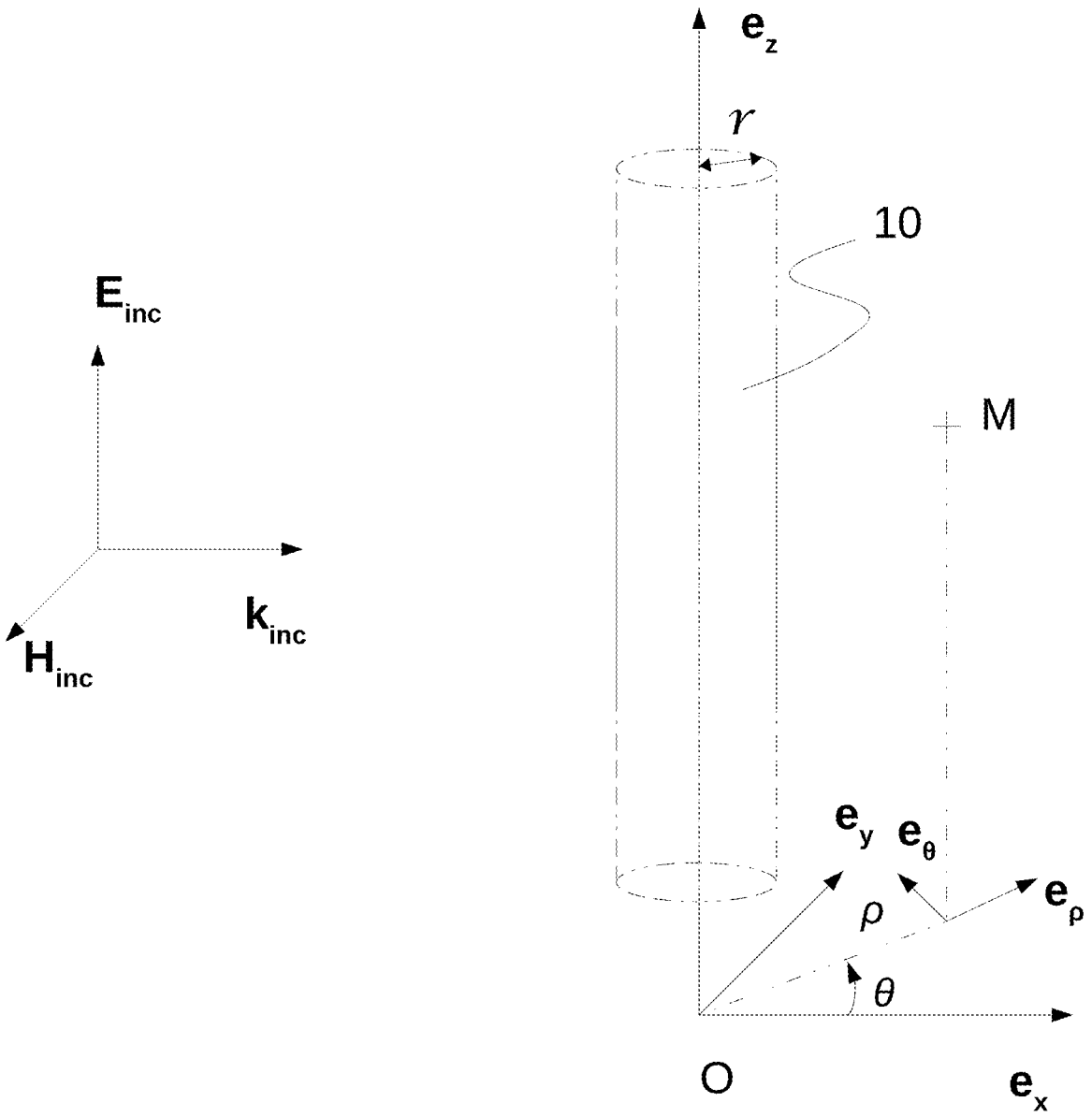
FIG. 4 shows a perspective view of a cylindrical object of circular cross section, of infinite height and of radius r, exposed to an incident electromagnetic field.

FIG. 4 illustrates a perfectly electrically conductive cylindrical obstacle 10 of infinite height and of circular cross section of radius r.

An orthonormal coordinate system (O; ex; ey; ez) is defined such that a longitudinal axis of revolution of the cylindrical obstacle 10 is substantially parallel in direction to that of the axis (Oz). A point M in space may thus be identified by its Cartesian coordinates (x, y, z) or its cylindrical coordinates (ρ, θ, z).

The obstacle 10 is placed in the incident electromagnetic field (Einc; Hinc). For the sake of simplicity of the description and equations that are presented here, the obstacle 10 is exposed to a plane, progressive, monochromatic electromagnetic wave, referred to as the EMW hereinafter, without, however, the scope of the invention being limited to this type of wave. The EMW is therefore characterized by a pulse co or, equivalently, by a frequency f or a wavelength λ, taking into account a given speed of propagation through the medium under consideration, for example air.

An orthogonal trihedron (kinc; Einc; Hinc) formed of a wave vector kinc of the EMW, of the incident electric field Einc and of the incident magnetic field Hinc, is shown. For the sake of simplicity of the description, the EMW is polarized along the axis (Oz), and the incident electric field Einc is therefore in the same direction as the axis of revolution of the obstacle 10. The wave vector kinc and the incident magnetic field Hinc therefore belong to the plane (Oxy).

The coordinate system (O; ex; ey; ez) is oriented such that the wave vector kinc and the magnetic field Hinc are collinear with the axes ex and ey, respectively.

$$\overrightarrow{E_{inc}} = E_0 e^{i(\omega t - kx)} \overrightarrow{e_z}$$

$$\overrightarrow{H_{inc}} = H_y(x;t)\overrightarrow{e_y}$$

$$\overrightarrow{k_{inc}} = \frac{2\pi}{\lambda}\overrightarrow{e_x} = k\overrightarrow{e_x}$$

A diameter of the obstacle 10 determines a maximum transverse dimension d of the obstacle. In the embodiment of FIG. 4, the ratio of the diameter of the cylindrical obstacle 10 to the wavelength λ is less than or equal to 1.

The study of the diffraction of an EMW by an infinite perfectly electrically conductive cylinder, with the assumptions mentioned above, has already been carried out previously, for example in the following documents: "Scattering of a Plane Electromagnetic Wave by a Small Conducting Cylinder", Kirk T. McDonald and "Recent Researches in Electricity and Magnetism", J. J. Thomson. The main elements, which are of use in understanding the invention, are summarized here.

When the electrically conductive obstacle 10 is placed in the incident electromagnetic field as illustrated in FIG. 4, the electromagnetic field sets charges in the electrically conductive obstacle 10 in motion, thus causing an induced electromagnetic field (Eind; Hind), comprising an induced electric field Eind and an induced magnetic field Hind, to appear. In the steady state, a total electromagnetic field (E; H), comprising a total electric field E and of a total magnetic field H, in the surroundings of the obstacle 10, therefore results from the sum of the incident electromagnetic fields and induces:

$$\vec{E}=\vec{E}_{inc}+\vec{E}_{ind}$$

$$\vec{H}=\vec{H}_{inc}+\vec{H}_{ind}$$

Henceforth, only the electric field will be considered, given that the magnetic field may always be deduced from the electric field by means of Maxwell's equations.

Conventionally, the symmetry of the problem leads to the induced electric field Eind having a single component along the axis ez. Similarly, the induced electric field Eind is independent of the z coordinate:

$$\vec{E}_{ind}=E_{ind_z}(\rho,\theta,t)\vec{e}_z=E_{ind_0}(\rho,\theta)e^{i\omega t}\vec{e}_z$$

where (ρ,θ,z) denote the cylindrical coordinates.

The induced electric field Eind is sought in the form:

$$E_{ind_z}(\rho,\theta,t)=\left(\sum_{n=-\infty}^{+\infty}E_n(\rho)e^{in\theta}\right)e^{i\omega t}$$

The vertical components of the induced electric field Eind and of the total electric field E are deduced from the wave equation applied to the electric field then projected onto the axis ez:

$$E_{ind_z}=\left(\sum_{n=-\infty}^{+\infty}A_nH_n^{(1)}(k\rho)e^{in\theta}\right)e^{i\omega t}$$

$$E_z=E_{inc_z}+E_{ind_z}=E_0e^{i(\omega t-k\rho\cos\theta)}+\left(\sum_{n=-\infty}^{+\infty}A_nH_n^{(1)}(k\rho)e^{in\theta}\right)e^{i\omega t}$$

where:

$H_n^{(1)}(k\rho)$ represents a first-order Hankel function;

An represents the Fourier coefficient associated with the first-order Hankel function $H_n^{(1)}(k\rho)$.

Quantities $\rho_k^*$ and $r_k^*$ that are rendered dimensionless with respect to the wave number k will be used hereinafter:

$$\rho_k^*=k\rho$$

$$r_k^*=kr$$

With the assumptions of FIG. 4:

H1: the radius r of the cylinder is small with respect to the wavelength λ;

H2: the obstacle 10 is a perfect electrical conductor;

it follows that:

$$H1:\ e^{-ik\rho\cos\theta}=e^{-i\rho_k^*\cos\theta}\approx(1-i\rho_k^*\cos\theta)\quad \text{pour}\,\rho_k^*<1$$

$$H2:\ E_0e^{-ir_k^*\cos\theta}+\sum_{n=-\infty}^{+\infty}A_nH_n^{(1)}(r_k^*)e^{in\theta}=0$$

Hence, at the surface of the cylinder, i.e. where ρ=r, the approximate equation is:

$$E_0(1-ir_k^*\cos\theta)=-\sum_{n=-\infty}^{+\infty}A_nH_n^{(1)}(r_k^*)e^{in\theta}$$

Through term-by-term identification, it is necessarily deduced therefrom that:

$$\frac{A_0}{E_0}=-\frac{1}{H_0^{(1)}(r_k^*)}$$

$$\frac{A_1}{E_0}=-\frac{A_{-1}}{E_0}=-\frac{i}{2}\frac{r_k^*}{H_1^{(1)}(r_k^*)}$$

$$\frac{A_n}{E_0}=0\,\forall\,n\in\mathbb{N}\setminus\{-1;0;1\}$$

and the expression for the vertical component of the total electric field E is:

$$E_z=E_0e^{i\omega t}(e^{-i\rho_k^*\cos\theta}+A_{-1}H_{-1}^{(1)}(\rho_k^*)e^{-i\theta}+A_0H_0^{(1)}(\rho_k^*)+A_1H_1^{(1)}(\rho_k^*)e^{i\theta})$$

With assumption H1 and according to the properties of Hankel functions of the first kind, the expressions for the coefficients A0, A−1 and A1 may be approximated:

$$\frac{A_0}{E_0}\sim\frac{i\pi}{2\left(\ln\left(\frac{2}{r_k^*}\right)-0.5772\right)}$$

$$\frac{A_1}{E_0}=-\frac{A_{-1}}{E_0}\sim\frac{\pi r_k^{*2}}{4}$$

The incident Hic, induced Hind and total H magnetic fields may deduced from Maxwell's equations.

The RCS σ of the obstacle 10 is deduced from the preceding results:

$$\sigma=\frac{4}{k}\sum_{n=-\infty}^{+\infty}|A_n|^2=\frac{4}{k}(|A_{-1}|^2+|A_0|^2+|A_1|^2)$$

assuming that the other terms An for [please insert formula] are negligible with respect to A0, A−1 and A1.

Now, with assumption H1:

$$\left|\frac{A_0}{E_0}\right| \sim \frac{\pi}{2\left(\ln\left(\frac{2}{r_k^*}\right) - 0.5772\right)} > \frac{\pi r_k^*}{4} \gg \frac{\pi r_k^{*2}}{4} \sim \left|\frac{A_1}{E_0}\right| = \left|\frac{A_{-1}}{E_0}\right|$$

Consequently, with assumption H1, the RCS σ of the obstacle 10 depends only on the coefficient A0, since the other terms are negligible with respect to this coefficient.

$$\sigma \approx \frac{4}{k}|A_0|^2$$

Figure 5:
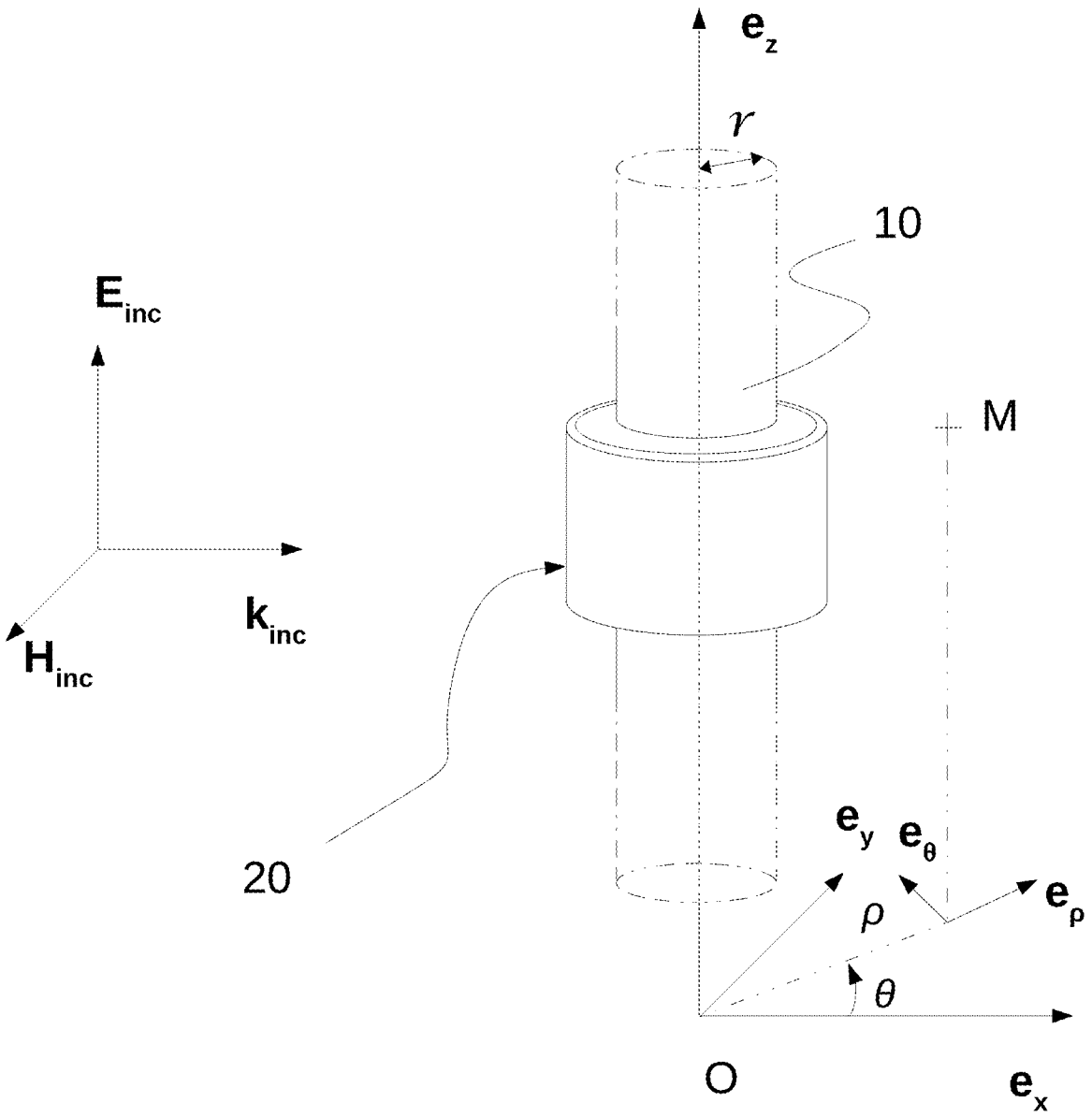
FIG. 5 shows a perspective view of a cylindrical object of circular cross section, of infinite height and the radius r, covered by a device according to the embodiment of FIG. 3 of the invention, and exposed to the incident electromagnetic field of FIG. 4.

FIG. 5 illustrates an obstacle 10 such as described in FIG. 4 and fitted with the device 20 according to the embodiment of FIG. 3 of the invention. The obstacle 10 is exposed to an EMW such as described in FIG. 4.

The incident electromagnetic wave causes electric currents to appear in the obstacle 10 and in the metal coating 22.

The device 20, forming an electromagnetic cavity, then acts as an antenna: a cavity electromagnetic field (Ecav; Hcav) appears in the dielectric material, which cavity electromagnetic field is subsequently made to radiate.

The resonant frequency of the electromagnetic field in a completely cylindrical cavity (Ecav; Hcav) is given by the expression:

$$f_{mn} = \frac{c}{2\pi\sqrt{\varepsilon_r}}\sqrt{\left(\frac{m}{r+t}\right)^2 + \left(\frac{n\pi}{h_p}\right)^2}$$

where:

r is the radius of the obstacle 10;

t is the thickness of the dielectric coating 21;

εr is the relative dielectric permittivity of the dielectric coating;

hp is the height of the device 20;

c is the speed of light in vacuum.

In particular, the expression for frequency of the transverse magnetic mode TM01 of the cavity electromagnetic field (Ecav; Hcav) is:

$$f_{01} = \frac{c}{2h_p\sqrt{\varepsilon_r}}$$

It has been seen above in the exemplary embodiment of FIG. 4 that, when the cylinder alone is subjected to an EMW, the incident electric field Einc of which is polarized along the axis of revolution of the circular cylindrical obstacle 10 and the wavelength of which is at least 10 times greater than the radius of the obstacle, the RCS σ of the obstacle 10 substantially depends only on the coefficient A0 and the total electric field E has a single component along the axis of revolution of the cylindrical object.

The device 20 of FIG. 5 is dimensioned so as to radiate the cavity electromagnetic field (Ecav; Hcav) according to the transverse magnetic mode TM01 at the wavelength λ of the incident wave. Specifically, a cavity electric field Ecav of such a cavity electromagnetic field has a nonzero component along the axis ez; it is capable of interfering with the induced electromagnetic field (Eind; Hind) radiated by the obstacle 10, with a view to cancelling out the RCS σ of the obstacle.

The height hp of the device 20 must therefore be substantially equal to:

$$\boxed{h_p = \frac{\lambda}{2\sqrt{\varepsilon_r}}}$$

In practice, once established theoretically, the value of the height hp may be optimized by electromagnetic simulation.

In the exemplary embodiment of FIG. 5, the incident (Einc; Hinc) and induced (Eind; Hind) electromagnetic fields are polarized along the axis ez. The cavity electric field Ecav must therefore also be polarized substantially along the same axis, as otherwise the total electric field E during the implementation of the device on the obstacle 10 will differ substantially from the total electric field E in the absence of an obstacle. The device 20 is dimensioned such that the transverse magnetic mode TM01 is the fundamental mode of the cavity electromagnetic field (Ecav; Hcav).

A condition on the thickness t of the dielectric coating 21 and on its relative dielectric permittivity εr necessarily ensues:

$$\boxed{\frac{h_p}{r+t} > \pi}$$

or else:

$$r + t < \frac{\lambda}{2\pi\sqrt{\varepsilon_r}}$$

For a given wavelength λ and dielectric material of relative permittivity εr, equation (1) gives the height of the device 20.

The condition of equation (3) restricts the radial thickness of the dielectric coating 21. In practice, the ratio of:

the height of the device 20 to the sum of the radius of the cylindrical obstacle 10 and of the thickness of the dielectric coating 21 is necessarily greater than π, i.e., around 3.

It follows that the thickness of the dielectric coating 21 is not restricted to one value. The dielectric coating 21 may thus be dimensioned so as to optimize the effectiveness of the device 20. This optimization may for example be carried out by electromagnetic simulation, with a view to minimizing the RCS σ of the obstacle 10 as much as possible.

Once dimensioned in terms of thickness and height, the device 20 makes it possible to act on the value of the modulus of the Fourier coefficient A0 so as to decrease it substantially, thus allowing the RCS σ of the obstacle 10 to be decreased.

In practice, the RCS σ of the obstacle 10 is decreased in a frequency band centered on f, corresponding substantially to the passband of the cavity. The most substantial attenuation occurs at the frequency f.

Figure 6:
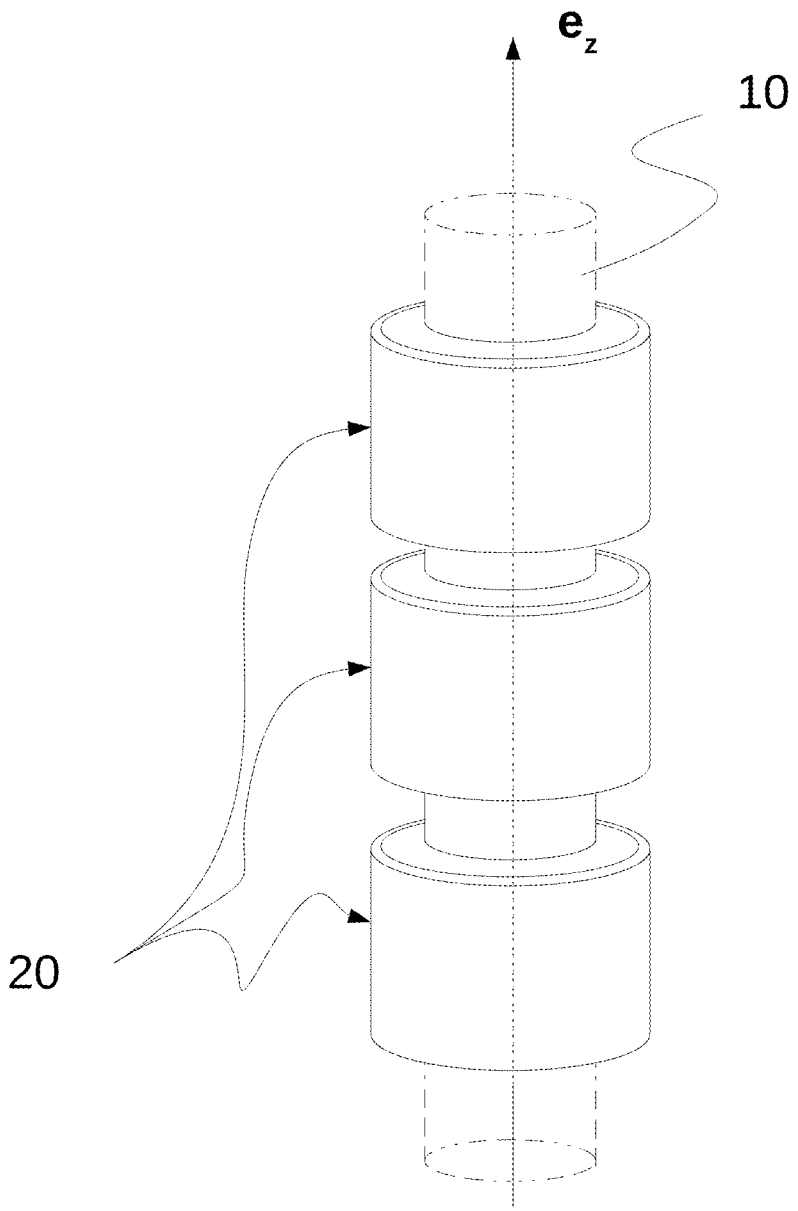
FIG. 6 shows a perspective view of a cylindrical object of circular cross section and of infinite height, covered by an assembly of three electromagnetic coatings according to the embodiment of FIG. 3 of the invention.

The energy of the cavity electromagnetic field (Ecav; Hcav) may, in some cases, for example in the case of obstacles of great heights, not be enough to compensate sufficiently for the energy of the induced electromagnetic field (Eind; Hind) and to effectively decrease the RCS σ of the obstacle 10 when the device 20 is implemented. It is then advantageous to connect a plurality of devices similar to the device 20 in series along the axis of the obstacle 10, as illustrated in FIG. 6. Preferably, the one or more devices 20 cover the entire surface of the obstacle so as to decrease the RCS σ of the obstacle as much as possible and to make the obstacle 10 substantially invisible to the radiation of the antenna.

It should be noted that once the device 20 has been dimensioned as described above for the frequency f associated with the wavelength λ, the device can still be used for any frequency located within the passband of the electromagnetic cavity formed by the obstacle 10 and device 20.

For the sake of clarity and simplicity of the mathematical expressions, a cylinder of infinite height has been considered above. Equations (1), (2) and (3) are still valid in the case of a cylinder of finite height and the above reasoning is similar, mutatis mutandis.

The invention is not limited to the concealment of a substantially cylindrical object of circular cross section such as that which has been used to support the reasoning and to allow the equations to be simplified.

Figure 7A:
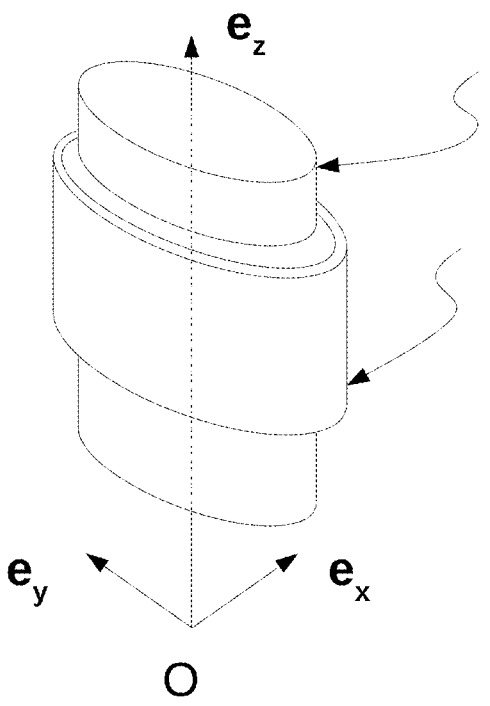
FIG. 7*a* shows a perspective view of a second embodiment of the invention covering an obstacle taking the shape of an elliptical cylinder.
Figure 7B:
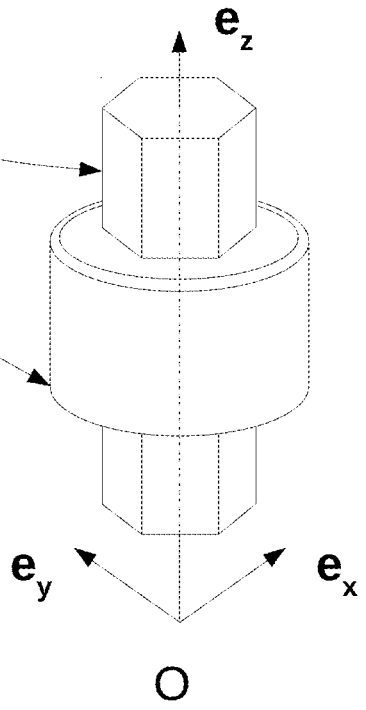
FIG. 7*b* shows a perspective view of a third embodiment of the invention covering an obstacle taking the shape of a cylinder of hexagonal cross section.
Figure 7C:
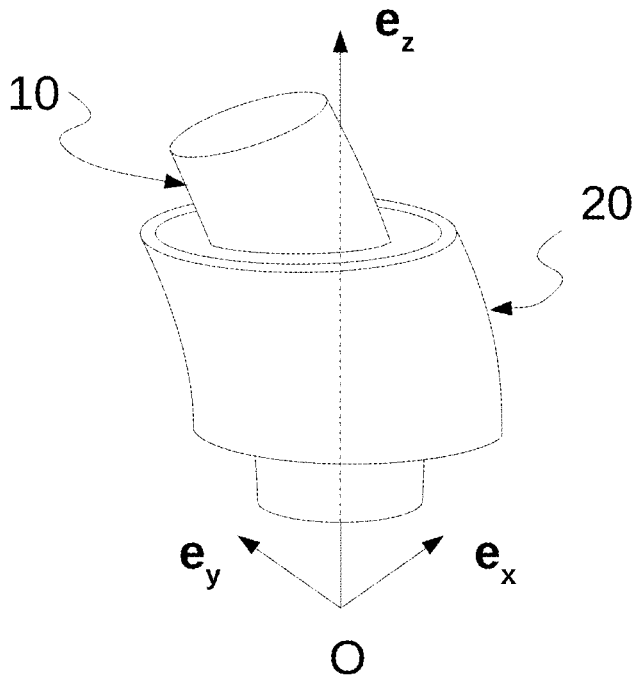
FIG. 7*c* shows a perspective view of a fourth embodiment of the invention covering a tubular and slightly incurved obstacle.

In variants of the embodiment of FIG. 3 which are illustrated in FIGS. 7*a*, 7*b* and 7*c*, the device 20 is used to conceal objects 10 of various shapes:

in FIG. 7*a*, the dielectric coating 21 and the metal coating 22 of the device 20 are substantially cylindrical sleeves of elliptical annular cross section and are implemented on an electrically conductive obstacle 10 substantially taking the shape of an elliptical cylinder;

in FIG. 7*b*, the dielectric coating 21 and the metal coating 22 of the device 20 are substantially cylindrical sleeves of substantially circular annular cross section and are implemented on a substantially cylindrical electrically conductive obstacle 10 of hexagonal cross section, the shape of which the dielectric coating is adjusted to fit;

in FIG. 7*c*, the dielectric coating 21 and the metal coating 22 of the device 20 form substantially cylindrical sleeves of annular cross section, in which the dielectric coating and the metal coating are curved and are implemented on a tubular and slightly incurved electrically conductive obstacle 10.

The exemplary embodiments presented in the figures are not limiting and other geometries of objects 10 to be concealed may be envisaged.

A person skilled in the art will then implement the complete equations and the simulations according to the specific case in order to calculate the characteristics of the device according to the invention.

In one embodiment, the dielectric coating 21 is composed of a plurality of dielectric materials, which may or may not be solid. The relative dielectric permittivity εr to be taken into consideration is then an equivalent relative dielectric permittivity εreq, which should be understood as being a dielectric permittivity that a uniform material standing in for the plurality of dielectric materials of the coating 21 would have, while retaining, for the same dimensions, identical physical properties in terms of response to an electric field.

In one implementation, the incident electromagnetic field Einc; Hinc is radiated by an antenna that is located in proximity to the obstacle 10.

Figures 8A, 8B, 8C:
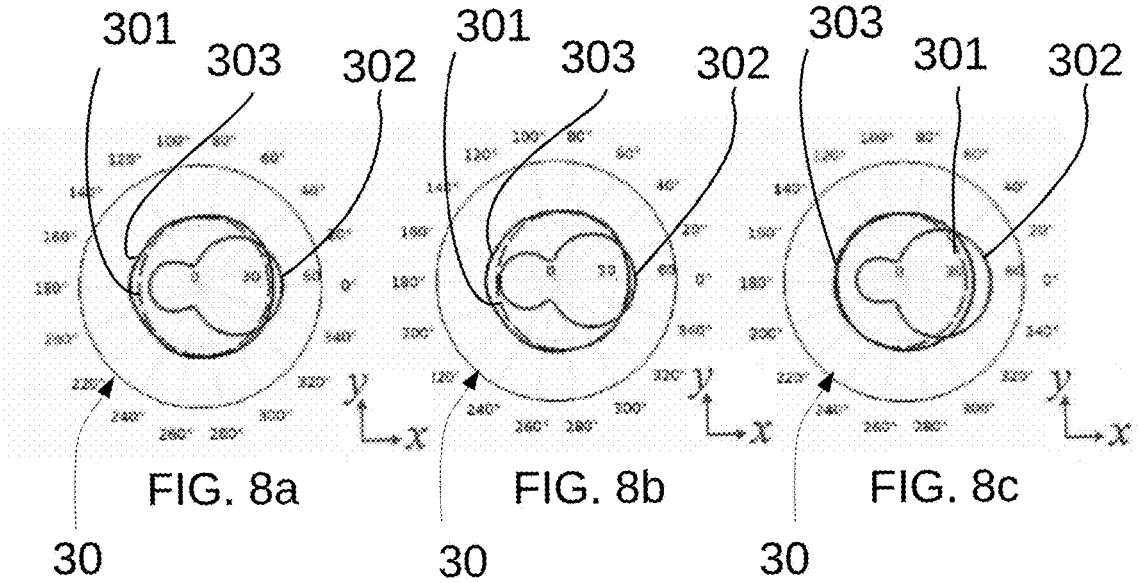
FIG. 8*a* shows the radiation pattern in a horizontal plane of a wire antenna polarized along a vertical axis in the absence of an obstacle, in the presence of an electrically conductive obstacle substantially taking the shape of an elliptical cylinder of vertical axis, and in the presence of the electrically conductive obstacle partially covered by a device according to the embodiment of FIG. 7*a*, respectively.
FIG. 8*b* shows the radiation pattern in a horizontal plane of a wire antenna polarized along a vertical axis in the absence of an obstacle, in the presence of a substantially cylindrical electrically conductive obstacle of hexagonal cross section and of vertical axis, and in the presence of the electrically conductive obstacle partially covered by a device according to the embodiment of FIG. 7*b*, respectively.
FIG. 8*c* shows the radiation pattern in a horizontal plane of a wire antenna polarized along a vertical axis in the absence of an obstacle, in the presence of a substantially tubular and curved electrically conductive obstacle, and in the presence of the electrically conductive obstacle partially covered by a device according to the embodiment of FIG. 7*c*, respectively.

FIGS. 8*a*, 8*b* and 8*c* each represent the radiation patterns 30 in a horizontal plane of an isotropic monopole wire antenna polarized along a vertical axis, in the following three cases:

the dashed line 301 illustrates the radiation of the antenna in the absence of an obstacle;

the line 302 illustrates the radiation of the antenna in the presence of the electrically conductive obstacle 10;

the line 303 illustrates the radiation of the antenna in the presence of the electrically conductive obstacle on which the device 20 has been implemented.

The shapes of the electrically conductive obstacle 10 and of the device 20 in the cases of FIGS. 8*a*, 8*b* and 8*c* are those of the embodiments of FIGS. 7*a*, 7*b* and 7*c*, respectively.

FIGS. 8*a*, 8*b* and 8*c* show that the radiation pattern is affected substantially by the presence of the obstacle: the line 302 in the presence of the electrically conductive obstacle 10 deviates significantly from the line 301. In the three embodiments illustrated in these figures, the line 303 is substantially identical to the line 301, which shows that implementing the device 20 on the electrically conductive obstacle 10 allows the radiation pattern obtained in the absence of an obstacle to be recovered. The electrically conductive obstacle 10 is thus made invisible to the radiation of the antenna, at least for the wavelength λ under consideration.

Figures 9A, 9B, 9C:
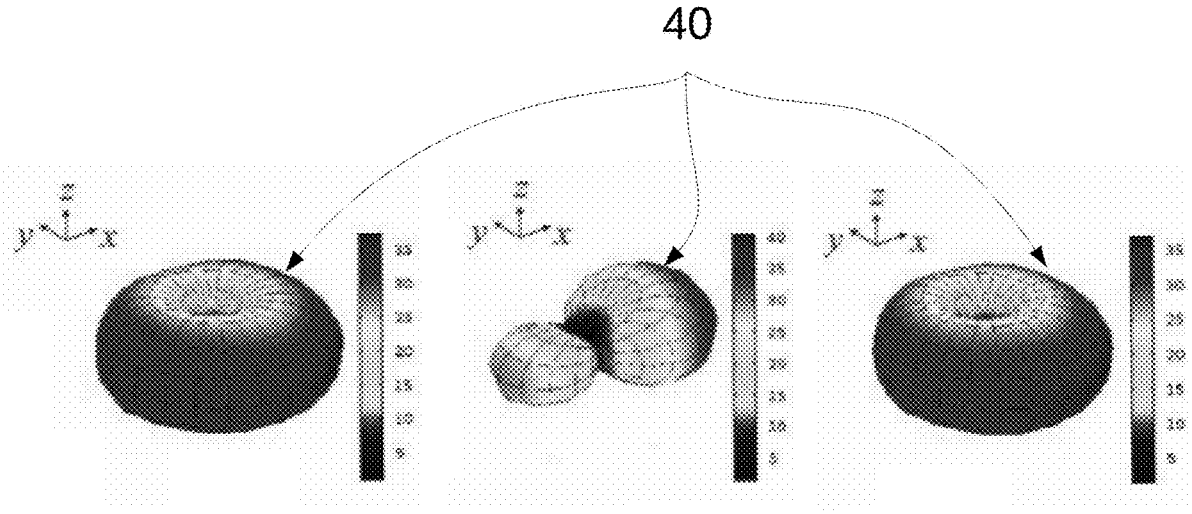
FIGS. 9*a*, 9*b* and 9*c* show the three-dimensional radiation pattern of a wire antenna polarized along a vertical axis in the absence of an obstacle, in the presence of a cylindrical electrically conductive obstacle of circular cross section and of vertical axis, and in the presence of the electrically conductive obstacle partially covered by a device according to the embodiment of FIG. 3, respectively.

FIGS. 9*a*, 9*b* and 9*c* each illustrate a three-dimensional radiation pattern 40 of an isotropic monopole wire antenna polarized along a vertical axis in the absence of an obstacle, in the presence of the electrically conductive obstacle 10, of vertical axis, and in the presence of the electrically conductive obstacle on which the device 20 according to the embodiment of FIG. 3 has been implemented, respectively.

Comparing FIGS. 9*a* and 9*b* shows the effect of the presence of the obstacle on the radiation of the antenna.

FIGS. 9*a* and 9*c* show that the radiation pattern 40 in the absence of an obstacle or in the presence of the electrically conductive obstacle 10 covered at least partially by the device 20 is substantially identical in both cases; the presence of the device 20 therefore allows the electrically conductive obstacle 10 to be made transparent to the radiation of the antenna, at least for the wavelength λ under consideration.

The same conclusions apply when the electromagnetic field is received by the antenna.

As an exemplary application of the invention, consider a monopole antenna 50 with a height of 57 cm. A cylindrical obstacle 10 of circular cross section, with a height of 70 cm and a radius r=10 cm, is located 50 cm away from the antenna 50. It is exposed to an EMW with a frequency f=125 MHz emitted by the antenna, i.e., a wavelength λ=2.40 m.

The assumption "r small with respect to wavelength" then indeed holds since:

$$\frac{r}{\lambda} = \frac{0.10}{2.40} = 0.042 < 1$$

The device 20 according to the invention is placed on the obstacle 10 so as to make the obstacle invisible to the EMW. The device 20 is composed of a dielectric coating 21 with a relative permittivity εr=2.9, for example polycarbonate, with a height:

$$h_p = \frac{\lambda}{2\sqrt{\varepsilon_r}} = \frac{2.40}{2\sqrt{2.8}} \approx 70.5 \text{ cm}$$

Condition (2) implies that:

$$r+t<22.4 \text{ cm}$$

$$t<12.4 \text{ cm}$$

A dielectric coating 21 of a thickness of 10 mm, for example, is therefore suitable for placement in the device 20.

For a frequency f=135 MHz, i.e., a wavelength λ=2.22 m, the height hp of the coating should be around 65 cm.

Electromagnetic simulations run in parallel allow the dimensions of the device 20 to be optimized so as make the obstacle invisible to the antenna.

In the case described above, the optimal coating heights obtained are:

$h_p$=68 cm à $f$=125 MHz $h_p$=64 cm à $f$=135 MHz

These values are close to the values obtained theoretically.

The device according to the invention has the following advantages with respect to the prior art:

simplicity of realization;

low cost of the solution;

adaptability to complex shapes.

With regard to this last point, it should be noted that if the invention as described above substantially takes the shape of a (potentially curved) cylindrical sleeve, then these are nonlimiting exemplary embodiments of the invention, and it may be adjusted to fit objects of various shapes.

By way of example, the invention may be adjusted to fit cubic, conical or spherical objects, or those resulting from a combination of the shapes.

The device according to the invention is for example implemented on an aircraft longeron, or on another structure masking a nearby VHF antenna.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. An assembly comprising an obstacle and a device, intended to be subjected to an incident electromagnetic wave of wavelength λ, wherein:

the obstacle is formed of an electrically conductive material and takes a substantially cylindrical shape of longitudinal axis (O; ez), which longitudinal axis is substantially perpendicular to a direction of propagation of the incident electromagnetic wave, said obstacle furthermore having a maximum transverse dimension d such that the ratio d/λ is less than 1;

the device is placed over all or part of a surface of the obstacle so as to decrease a radar cross section of said obstacle, and includes:

a sleeve of a dielectric coating, of equivalent relative dielectric permittivity εreq, of height hp, along a longitudinal axis of said sleeve, which is substantially equal to $$\frac{\lambda}{2\sqrt{\varepsilon_{req}}};$$

a sleeve of an electrically conductive coating placed around the periphery of the dielectric coating, of the same height hp along a longitudinal axis of said sleeve as the height of the dielectric coating sleeve.

2. The assembly as claimed in claim 1, wherein the dielectric coating is formed of a single dielectric material.

3. The assembly as claimed in claim 1, wherein the dielectric coating includes a plurality of dielectric materials, a relative dielectric permittivity and a thickness of each of the component dielectric materials of said coating determining the equivalent relative dielectric permittivity εreq.

4. The assembly as claimed in claim 1, wherein the height hp of the dielectric coating is optimized by means of direct electromagnetic simulation so as to adjust said height for the purpose of seeking a minimum radar cross section for the obstacle.

5. The assembly as claimed in claim 1, wherein a thickness of the dielectric coating is optimized by means of direct electromagnetic simulation to adjust said thickness for the purpose of seeking a minimum radar cross section for the obstacle.

6. The assembly as claimed in claim 1, wherein:

the obstacle is an elliptical cylinder;

the dielectric coating and the electrically conductive coating substantially take the shape of elliptical cylindrical sleeves; and the dielectric coating is adjusted to fit the obstacle and the conductive coating is adjusted to fit the sleeve of said dielectric coating.

7. The assembly as claimed in claim 6, wherein the generatrix ellipse of the obstacle is a circle and wherein the dielectric coating and the electrically conductive coating substantially take the shape of circular cylindrical sleeves.

8. The assembly as claimed in claim 1, wherein the obstacle, the dielectric coating and the conductive coating are slightly incurved.

9. The assembly as claimed in claim 1, wherein at least one of the obstacle or the electrically conductive coating comprise metals.

10. A vehicle including an assembly as claimed in claim 1.

11. The vehicle according to claim 10 comprising at least one of a sea vehicle, an air vehicle or a land vehicle.

* * * * *